United States Patent [19]

Kyogoku

[11] 4,240,345

[45] Dec. 23, 1980

[54] SELECTIVE DRUM PRINTER WITH AXIALLY DIVIDED MULTICOLOR INK ROLLER

[75] Inventor: Hiroshi Kyogoku, Kawasaki, Japan

[73] Assignees: Canon Kabushiki Kaisha; Canon Denshi Kabushiki Kaisha, both of Japan

[21] Appl. No.: 23,275

[22] Filed: Mar. 23, 1979

Related U.S. Application Data

[63] Continuation of Ser. No. 852,537, Nov. 17, 1977, abandoned, Continuation of Ser. No. 693,484, Jun. 7, 1976, abandoned.

[30] Foreign Application Priority Data

Jun. 19, 1975 [JP] Japan ..... 50/74760

[51] Int. Cl.[3] ..... B41J 27/00

[52] U.S. Cl. ..... 101/103; 101/106; 101/110; 101/193; 101/205; 235/58 P

[58] Field of Search ..... 101/97, 103, 106, 109, 101/401, 193, 401.1, 171, 205–210, 93.29, 110; 235/60.18, 60.2, 58 P

[56] References Cited

U.S. PATENT DOCUMENTS

| | | | |
|---|---|---|---|
| 287,383 | 10/1883 | Kendall et al. | 101/206 |
| 1,788,594 | 1/1931 | Robinson et al. | 101/401 |
| 2,869,454 | 1/1959 | Lang | 101/103 X |
| 3,067,056 | 12/1962 | Remer | 101/401 X |
| 3,229,626 | 1/1966 | Arps | 101/93.29 |
| 3,367,264 | 2/1968 | Rydman | 101/110 |
| 3,420,164 | 1/1969 | Lee | 101/93.29 |
| 3,734,012 | 5/1973 | Huggins | 101/103 X |
| 3,754,504 | 8/1973 | Clary | 101/336 |
| 3,858,705 | 1/1975 | Reitano | 101/336 |
| 3,939,766 | 2/1976 | Darwin | 101/106 X |

*Primary Examiner*—Edward M. Coven

*Attorney, Agent, or Firm*—Fitzpatrick, Cella, Harper & Scinto

[57] ABSTRACT

A printing device of a construction, wherein a plurality of printing hammers are arranged in parallel facing toward a character wheel provided on its outer peripheral surface with a plurality of character types to be struck by the printing hammers through a printing paper, etc., interposed between the printing hammers and the character wheel, and an ink applying device is kept in contact with the character wheel to apply printing ink onto the type face of the characters, the ink applying device having on its surface discrete sections to apply a printing ink of a color to a particular character to be struck by a particular printing hammer out of a plurality of the printing hammers, and another printing ink of another color to the remainder of the characters to be struck by the remainder of the printing hammers.

4 Claims, 4 Drawing Figures

SELECTIVE DRUM PRINTER WITH AXIALLY DIVIDED MULTICOLOR INK ROLLER

This is a continuation of application Ser. No. 852,537 filed Nov. 17, 1977, now abandoned, which is a continuation of Ser. No. 693,484 filed June 7, 1976, now abandoned.

BACKGROUND OF THE INVENTION

This invention relates to a simple printing device capable of presenting clear print-out of informations on recording mediums.

Heretofore, a printing device which prints out operational results of electronic computers, and so on has been so constructed to make a clear distinction, for example, between positive (+) numerical data and negative (−) numerical data by printing the positive numerical data with black ink and the negative data with red ink so as to enable anyone to clearly recognize informations printed on the recording medium.

In order to carry out such segregated printing as mentioned above, the conventional printing device has been provided with a simple printing ink tape or ribbon which impregnates therein both red and black inks in a discrete section for each, and the printing operation is carried out by selecting either a red ink ribbon or a black ink ribbon through an electrically or mechanically controlled device. In this ink ribbon, frequency of printing informations with the red ink ribbon is far less than that of printing with the black ink ribbon with the consequence that, on many occasions, even when the black ink ribbon becomes exhausted, the red ink ribbon is still usable. Accordingly, when the black ink ribbon is to be replaced, the still usable red ink ribbon is discarded, which is a considerable waste against saving of resources.

Moreover, the minus (−) symbol has heretofore been printed either in red on the symbol place (as shown by m in FIG. 1A in the accompanying drawing to be referred to later), or by causing the symbol to float in front of the numerical data (as shown by m in FIG. 1B). In any of the above-mentioned cases, however, the ink ribbon is required to be changed over, which slows down the printing speed, requires a separate mechanism for changing-over of the ink ribbon, and so is liable to complicate the printing mechanism as a whole.

SUMMARY OF THE INVENTION

In view of the afore-described various disadvantages inherent in the known type of printing device, it is a primary object of the present invention to provide a printing device of a simple construction which is capable of printing characters with desired clarity.

It is another object of the present invention to provide a printing device capable of performing high quality printing operations by specially working the type face of the characters.

It is still another object of the present invention to provide a printing device which is capable of performing the printing operations with a small operational energy.

The foregoing objects, other objects as well as construction and operations of the printing device according to the present invention will become more apparent and understandable from the following detailed description thereof when read in conjunction with the accompanying drawing.

DETAILED DESCRIPTION OF PREFERRED EMBODIMENT

(a) Construction of the Device

Figure 2:
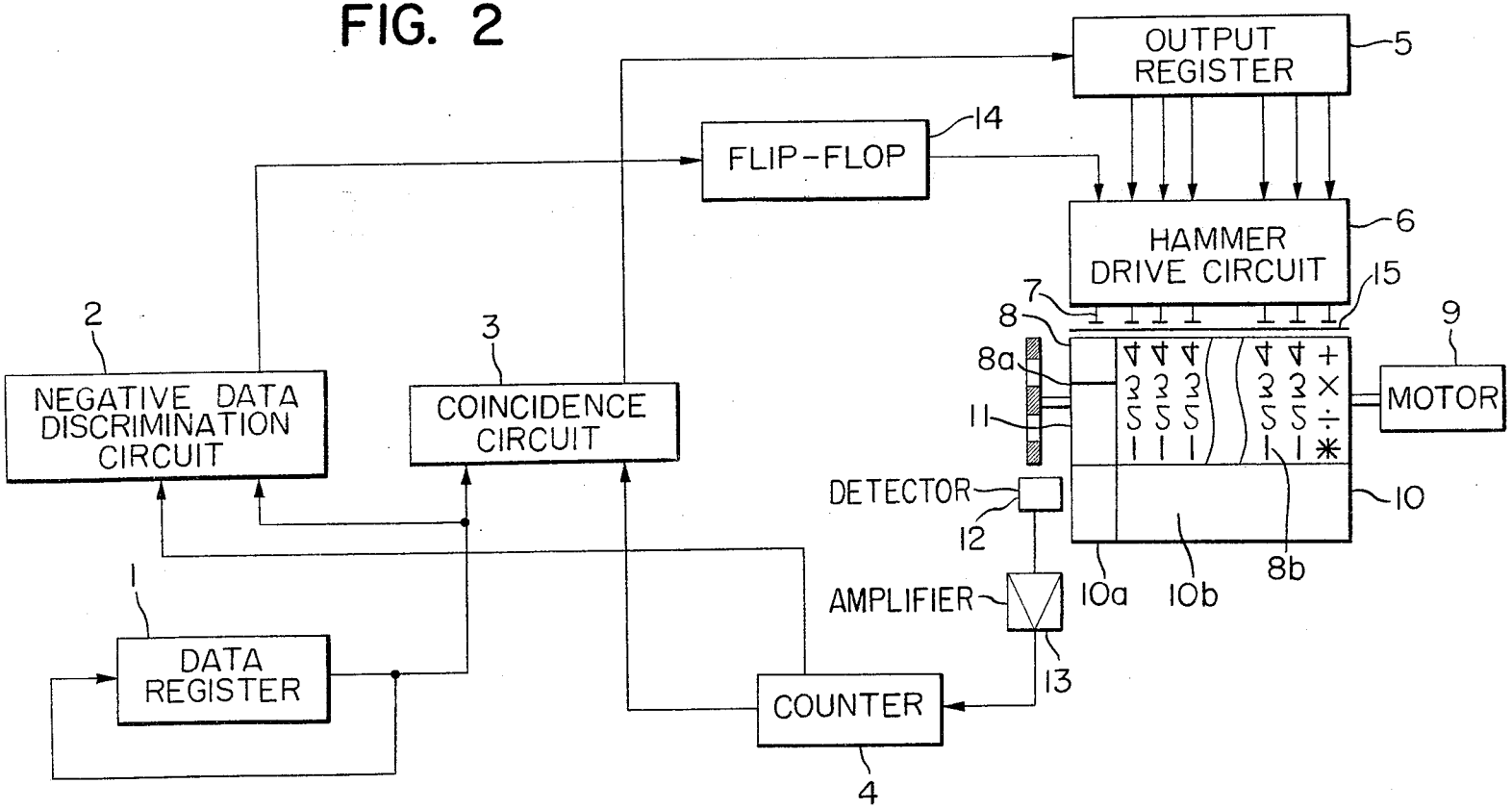
FIG. 2 is a schematic block diagram showing one embodiment of the printing device according to the present invention.

Referring now to FIG. 2 which shows a schematic block diagram of one embodiment of the printing device according to the present invention, a reference numeral 1 designates a data register which stores and holds in memory those data to be printed out, and which is connected with a negative data discrimination circuit 2 and a coincidence circuit 3 in a manner to feed those stored data. A counter 4 is also connected to the coincidence circuit 3. This coincidence circuit 3 is connected with an output register 5 in such a manner that it compares the data sent from the data register 1 with the reference data sent from the counter 4, and when both data agree each other in content, it sends out a coincidence signal, and when they do not agree, it sends out a non-coincidence signal. The coincidence or non-coincidence signal is then forwarded to a hammer drive circuit 6, and the printing hammers are driven in response to the coincidence signal.

A reference numeral 8 designates a character wheel which is provided on the outer cylindrical peripheral surface thereof with numerical values, symbols, etc., and, at the left side 8*a* thereof with a minus (−) symbol to clearly indicate the printed information. The characters, or the character wheel bearing the characters on the peripheral surface thereof, are made of an elastic material such as organic elastic material, metal material, inorganic material, or those others equivalent to such materials. By such construction, the printing energy of the device becomes such that an energy value which is as small as 10 g.cm to 20 g.cm is sufficient to perform the printing operation on a printing paper.

The characters on the surface of the character wheel 8 are so formed that the type faces thereof are rendered coarse. The coarsening of the type faces of the characters as such is achieved by mixing a small amount of additives to the character wheel 8, or by a mechanical expedient such as blast horning, etc., or by treating the character wheel surface mixed with the abovementioned additives by means of blast horning, whereby the printing ink, spotted in spherical shape, can be uniformly spread out over the entire type faces, and the quality of the printed characters can thereby be improved.

The characters, or the character wheel 8 bearing the characters on the peripheral surface thereof can be made of the following materials: polyurethane, butadiene, vinyl acetate, natural rubber, isoprene rubber, styrene rubber, butyl rubber, butadiene rubber, nitrile rubber, chloroprene rubber, polysulfide synthetic rubber, silicone rubber, fluoride rubber, and so on.

Also, for the additives, there are: zinc white, red lead, chrome yellow, silver red, ultramarine, prussian blue, cobalt oxide, titanium oxide, iron black, red iron oxide, molybdenum red, and so on.

The character wheel 8 is driven by appropriate driving means such as, for example, a motor 9, etc. Rotation of the character wheel 8 causes an ink roller 10, which is kept in pressure contact with the character wheel 8, to rotate. With rotation of the ink roller 10, the character wheel 8 sequentially receives transfer of ink thereonto from the ink roller. The ink roller 10 is impregnated at its one portion 10*a* thereof corresponding to a character or symbol on the character wheel 8 (in the illustrated embodiment, corresponding to the minus (−) symbol 8*a*) with red ink, for instance, and, at the other portion 10*b* corresponding to the remaining characters, with blank ink. Also, there is provided a circular disc 11 which rotates in synchronism with rotation of the character wheel 8, on one portion of which a magnet (not shown), for example, is disposed. In this way, a reference pulse signal is obtained by detection means 12 to detect variations in the magnetic field due to movement of the magnet, and this pulse signal is amplified and shaped by an amplifier 13 and then fed to the abovementioned counter 4. The output from the counter 4 is fed to both coincidence circuit 3 and negative data discrimination circuit 2. When the coincidence circuit detects a negative data from the data register 1, it sets a flip-flop circuit 14 to actuate the hammer drive circuit 6 so as to print the minus (−) symbol of the character wheel 8 onto the printing paper 15.

(b) Operation of the Device

Now, hereinbelow, the operations of the printing device of the above-described construction will be explained.

When it is determined by the negative data discrimination circuit 2 that the data stored in the data register 1 are not negative, the flip-flop circuit 14 is not set, but variations in the magnetic field emanating from the disc 11 rotating in synchronism with the character wheel 8 are detected, and every time a coincidence is obtained between an output from the counter 4 which changes its contents of count by a pulse signal from the detection means 12 which generates the pulse signal and an output from the data register 1, the coincidence circuit 3 sends out a coincidence signal to the output register 5. After comparing all the contents of the data register 1 with a content of one count in the counter 4, the contents of the output register 5 are parallelly applied to the hammer drive circuit 6, and the printing hammer 7 is driven in response to the coincidence signal to print the content of the data register 1 onto a printing paper. The abovementioned coincidence action is performed every time the content of the counter varies.

Figure 1A:
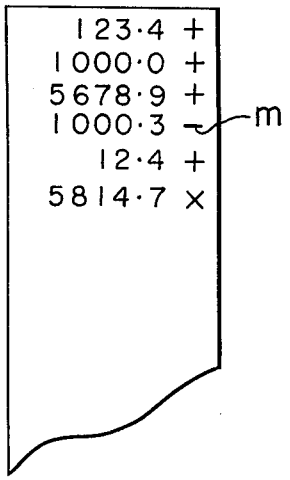
FIG. 1(A) PRIOR ART
FIG. 1A is one example of printing characters by the conventional printing device.
Figure 1B:
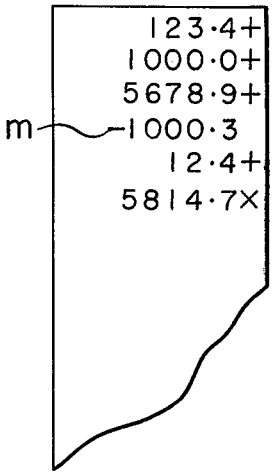
FIG. 1(B) PRIOR ART
FIG. 1B is another example of printing characters by the conventional printing device.
Figure 3:
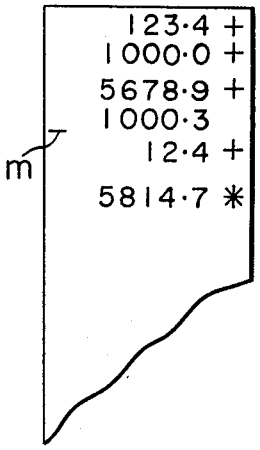
FIG. 3 is one example of printing characters by the printing device of the present invention.

However, when the content of the data register 1 is found by the negative data discrimination circuit 2 to be a negative numerical data, the flip-flop circuit 14 is set to strike the type of the minus (−) symbol which is disposed at the left end part 8*a* of the character wheel 8, and applied on its face with the red ink disposed at the left end 10*a* of the ink roller 10 with the printing hammer 7 through the printing paper 5, whereby a red print of the minus (−) symbol is made at the left end of the printing paper as shown in FIG. 3. Needless to say, the other numerical data and symbols are all printed in black.

In the foregoing description, the explanations have been made for the embodiment, in which the ink roller is utilized. However, the present invention is also applicable to an ink ribbon.

Thus, the printing device according to the present invention which has so far been described in detail provides a particular printing section to distinguish one printing mode from the other, so that no time becomes required for selective change-over of the red and black ink. Moreover, printing speed and efficiency in the use of the printing ink are improved, and no complications are called for in the construction of the printing device.

What is claimed is:

1. A printing device, comprising in combination:

(a) a character type wheel provided with a plurality of character type rings, each of which is disposed along a shaft of said character type wheel, and in which a first character type symbol for printing a mark of a particular information among a plurality of informations to be printed is arranged on one of said plurality of character rings, and a second character type symbol is arranged on the remaining character type rings for printing said plurality of informations on a printing medium;

(b) hammer means to strike said character type wheel;

(c) ink roller means including, in coaxial disposition, a first color and a second ink roller portion impregnated with ink of a second color, said first ink roller portion facing the character type ring having said first character symbol thereon, and said second ink roller portion facing the remaining character type rings;

(d) memory means capable of storing therein discriminating information to discriminate between said particular information among said plurality of informations, and one of said plurality of informations;

(e) control means to read out the contents stored in said memory means, said control means being operative in response to the position of said first character type symbol on said character type wheel and a position of said second character type symbol;

(f) a first memory to store therein said discriminating information read out of said memory means by said control means, when said particular information in said plurality of informations and said dicriminating information are stored in said memory means;

(g) a second memory to store therein said particular information read out of said memory means by said control means, when said particular information in said plurality of informations and said discriminating information are stored in said memory means; and (h) drive means connected with said first and second memories, for striking said first character type symbol charged with said first color ink of said first ink roller portion on said ink roller means through said recording medium in response to said particular information stored in said first memory, and for striking said second character type symbol charged with said second color ink of said second ink roller portion on said ink roller means through said recording medium.

2. The printing device as claimed in claim 1, wherein said character types on said plurality of character type rings are formed of synthetic high polymer compound.

3. The printing device as claimed in claim 1, wherein said character type ring having said first character type symbol contains therein a symbol "—" and the character type rings having said second character type symbol contains therein symbols representing other mathematical functions.

4. The printing device as claimed in claim 1, wherein said character type wheel is provided at one end of said shaft with the character type ring having thereon the first character type symbol, and, at the other end of said shaft, with the character type rings having the second character type symbols, and character type rings having thereon numerical character types being provided between said two character type rings at both ends of said shaft.

* * * * *

UNITED STATES PATENT AND TRADEMARK OFFICE

CERTIFICATE OF CORRECTION

PATENT NO. : 4,240,345

DATED : December 23, 1980

INVENTOR(S) : HIROSHI KYOGOKU

It is certified that error appears in the above-identified patent and that said Letters Patent are hereby corrected as shown below:

Claim 4, line 1, "claim 1" should read --claim 3--.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*